US007813922B2

(12) United States Patent
Ramo et al.

(10) Patent No.: US 7,813,922 B2
(45) Date of Patent: Oct. 12, 2010

(54) AUDIO QUANTIZATION

(75) Inventors: Anssi Ramo, Tampere (FI); Lasse Laaksonen, Nokia (FI); Adriana Vasilache, Tampere (FI)

(73) Assignee: Nokia Corporation, Espoo (FI)

( * ) Notice: Subject to any disclaimer, the term of this patent is extended or adjusted under 35 U.S.C. 154(b) by 878 days.

(21) Appl. No.: 11/700,732

(22) Filed: Jan. 30, 2007

(65) Prior Publication Data

US 2008/0180307 A1 Jul. 31, 2008

(51) Int. Cl.
*G10L 19/04* (2006.01)

(52) U.S. Cl. ..... 704/230

(58) Field of Classification Search ..... 704/230
See application file for complete search history.

(56) References Cited

U.S. PATENT DOCUMENTS

| | | | | |
|---|---|---|---|---|
| 6,671,669 | B1 * | 12/2003 | Garudadri et al. | 704/255 |
| 6,691,092 | B1 | 2/2004 | Udaya Bhaskar et al. | |
| 7,003,454 | B2 * | 2/2006 | Ramo | 704/223 |
| 7,523,032 | B2 * | 4/2009 | Heikkinen et al. | 704/207 |
| 7,587,314 | B2 * | 9/2009 | Vasilache et al. | 704/222 |

FOREIGN PATENT DOCUMENTS

| | | |
|---|---|---|
| EP | 0 395 440 | 4/1990 |
| WO | 01/31639 | 5/2001 |

OTHER PUBLICATIONS

ETSI EN 300 726 V8.0.1 (Nov. 2000) Digital cellular telecommunications system (Phase 2+); Enhanced Full Rate (EFR) speech transcoding; (GSM 06.60 version 8.0.1 Release 1999).

"Efficient Vector Quantization of LPC Paramters at 24 Bits/Frame" by Kuldip K. Paliwal, et al; IEEE Transactions on Speech and Audio Processing, vol. 1, No. 1, Jan. 1993, pp. 3-14.

"Interframe LSF Quantization for Noisy Channels" by Thomas Eriksson, et al; IEEE Transactions on Speech and Audio Processing, vol. 7, No. 5, Sep. 1999, pp. 495-509.

International Application No. PCT/EP2008/050217, Form PCT/ISA/220 (2 pages) dated Jun. 18, 2008 with Form PCT/ISA/210 (3 sheets) and Form PCT/ISA/237 (6 pages) Transmitting International Search Report and Written Opinion of the International Searching Authority (EPO).

* cited by examiner

*Primary Examiner*—Susan McFadden

(57) ABSTRACT

For supporting a selection of a predictive or non-predictive quantization in the scope of an audio signal coding, it is determined whether an error resulting with a non-predictive quantization of an audio signal segment lies below a predetermined threshold value. An audio signal segment quantized with the non-predictive quantization is provided as a part of an encoded audio signal at least in case it is determined that the error resulting with the non-predictive quantization of the audio signal segment lies below a predetermined threshold value. Otherwise, an audio signal segment quantized with predictive quantization is provided as a part of an encoded audio signal.

28 Claims, 3 Drawing Sheets

AUDIO QUANTIZATION

FIELD OF THE INVENTION

The invention relates in general to the field of audio coding and more specifically to the field of audio quantization.

BACKGROUND OF THE INVENTION

Audio encoders and decoders (codecs) are used for a wide variety of applications in communication, multimedia and storage systems. An audio encoder is used for encoding audio signals, like speech, in particular for enabling an efficient transmission or storage of the audio signal, while an audio decoder constructs a synthesized signal based on a received encoded signal.

When implementing codecs, it is thus an aim to save transmission and storage capacity while maintaining a high quality of the synthesized signal. Also robustness in respect of transmission errors is important, especially with mobile and voice over internet protocol (VoIP) applications. On the other hand, the complexity of the codec is limited by the processing power of the application platform.

In a typical speech encoder, the input speech signal is processed in segments, which are called frames. Usually the frame length is 10-30 ms. A lookahead segment of 5-15 ms of the subsequent frame may be available in addition. The frame may further be divided into a number of sub frames. For every frame, the encoder determines a parametric representation of the input signal. The parameters are quantized and transmitted through a communication channel or stored in a storage medium in a digital form. At the receiving end, the decoder constructs synthesized signal based on the received parameters.

The construction of the parameters and the quantization are usually based on codebooks, which contain codevectors optimized for the quantization task. In many cases, higher compression ratios require highly optimized codebooks. Often the performance of a quantizer can be improved for a given compression ratio by using prediction from the previous frame. Such a quantization will be referred to in the following as predictive quantization, in contrast to a non-predictive quantization which does not rely on any information from preceding frames. A predictive quantization exploits a correlation between a current audio frame and at least one neighboring audio frame for obtaining a prediction for the current frame so that for instance only deviations from this prediction have to be encoded, which also requires dedicated codebooks.

Prediction quantization might result in problems, however, in case of errors in transmission or storage. With predictive quantization, a new frame cannot be decoded perfectly, even when received correctly, if at least one preceding frame on which the prediction is based is erroneous. It is therefore possible to use a non-predictive quantization once in a while, in order to prevent long runs of error propagation. For such an occasional non-predictive quantization, which is also referred to as "safety-net" quantization, a codebook selector can be employed for selecting between predictive and non-predictive codebooks.

SUMMARY

Even though the safety-net quantization is an improvement over pure predictive quantization in terms of the overall performance with and without errors in storage or transmission, a considerable problem due to the predictive character of the quantization remains. Normally, prediction is used for almost 70 to 80% of the frames. In case of frame erasures, thus often up to five frames are lost, since there are still many consecutive predictive frames in a row.

It would be possible to increase the usage of the non-predictive quantization relative to the usage of the predictive quantization. This could be achieved for instance by means of a forced selection of the non-predictive quantization based on counters, which allow for example only three consecutive frames to be quantized based on prediction. Another option would be to use less prediction, for example by using smaller coefficients in the predictor matrix. Yet another option would be to use a preference gain for the quantization selector. That is, the predictive quantization might be required to be for example 1.3 times better in terms of quantization error than the non-predictive quantization before it is selected, thus reducing the usage of predictive quantization. All these options are suited to increase the robustness in respect of errors in storage or transmission, but decrease the quantization performance in case of a clean channel.

A method is described, which comprises determining whether an error resulting with a non-predictive quantization of an audio signal segment lies below a predetermined threshold value. The method further comprises providing an audio signal segment quantized with the non-predictive quantization as a part of an encoded audio signal at least in case it is determined that the error resulting with the non-predictive quantization of the audio signal segment lies below a predetermined threshold value. The method further comprises providing an audio signal segment quantized with predictive quantization as a part of an encoded audio signal otherwise.

Moreover, an apparatus is described, which comprises a processing component configured to determine whether an error resulting with a non-predictive quantization of an audio signal segment lies below a predetermined threshold value. The apparatus further comprises a processing component configured to provide an audio signal segment quantized with the non-predictive quantization as a part of an encoded audio signal at least in case it is determined that the error resulting with the non-predictive quantization of the audio signal segment lies below a predetermined threshold value. The apparatus further comprises a processing component configured to provide otherwise an audio signal segment quantized with predictive quantization as a part of an encoded audio signal.

The processing components of the described apparatus can be different components or a single component. The processing components can further be implemented in hardware and/or software. They may be realized for instance by a processor executing computer program code for realizing the required functions. Alternatively, they could be realized for instance by a hardware circuit that is designed to realize the required functions, for instance implemented in a chipset or a chip, like an integrated circuit. The described apparatus can be for example identical to the comprised processing components, but it may also comprise additional components.

Moreover, an electronic device is described, which comprises the described apparatus and an audio input component. Such an electronic device can be any device that needs to encode audio data, like a mobile phone, a recording device, a personal computer or a laptop, etc.

Moreover, a system is described, which comprises the described apparatus and in addition a further apparatus comprising a processing component configured to decode an encoded audio signal provided by the described apparatus.

Finally, a computer program product is proposed, in which a program code is stored in a computer readable medium. The program code realizes the proposed method when executed by a processor.

The computer program product could be for example a separate memory device, or a memory that is to be integrated in an electronic device.

The invention is to be understood to cover such a computer program code also independently from a computer program product and from a computer readable medium.

The invention proceeds from the consideration that below a certain threshold, a quantization error in an encoded audio signal segment may be negligible. It is therefore proposed that a non-predictive quantization is allowed to be selected whenever a considered error does not exceed a predetermined threshold. During the rest of the time, predictive quantization may be selected or further criteria may be evaluated for selecting between predictive and non-predictive quantization.

The invention thus provides a possibility of increasing the coding performance in case of channel errors. While the objective average quantization error increases, the threshold can be set so low that the error is hardly audible or not audible at all.

In one embodiment of the invention, the predetermined threshold is therefore a threshold below which the error is considered to be inaudible.

It may be assumed, for instance, that if spectral distortion due to a quantization lies below 1 dB, the distortion cannot be heard. It is thus not necessary to quantize a particular audio signal segment with predictive quantization to obtain for instance a very low spectral distortion of 0.5 dB, if the non-predictive quantization results in a spectral distortion of 0.9 dB, which is already sufficient from the human auditory point of view. Although the absolute error is larger for the individual audio signal segment, the quantization error cannot be heard in this case. If there were an audio signal segment erasure prior to this audio signal segment, the predictive quantization would perform poorly, but the parameters resulting in a non-predictive quantization could be decoded perfectly. Thus, an improvement becomes audible only for the audio signal segments with errors, while for clear channels, there is no audible degradation.

As becomes apparent from the above, a suitable error that may be compared with a predetermined threshold may thus be related to a spectral distortion over a frequency range between the original audio signal segment and an audio signal segment resulting with a non-predictive quantization. Calculating the error in terms of spectral distortion over the frequency range is also suited, for instance, for immittance spectral frequency (ISF) parameters or line spectral frequency (LSF) parameters belonging to an audio signal segment.

The spectral distortion SD for a respective audio signal segment can be represented by the following equation:

$$SD = \frac{1}{\pi}\int_0^{\pi}\left[\log S(\omega) - \log \hat{S}(\omega)\right]^2 d\omega,$$

where $\hat{S}(\omega)$ and $S(\omega)$ are the spectra of the speech frame with and without quantization, respectively. While this spectral distortion would be, for instance, a particularly exact measure for the codebook and quantization selection of linear predictive coding (LPC) parameters, the computational effort for determining this spectral distortion could be reduced by using simpler methods.

The considered error could also be obtained, for example, by combining weighted errors between a respective component of the original audio signal segment and a corresponding component of the audio signal segment resulting with the non-predictive quantization. The error could be obtained for example by combining weighted mean square errors, and the weighting of errors could be for example a psycho acoustically meaningful weighting. The expression psycho acoustically meaningful weighting vector means that the weighting vector emphasizes spectral components in an audio signal which are recognized by the human ear compared to those which are apparently not recognized by the human ear. The weighting vector can be calculated in several ways.

Such a psycho acoustically meaningful error could be for instance a weighted mean square error between ISF or LSF vector values.

In general, it is to be understood that the considered error may be determined based on the entirely quantized audio signal segment or on a partially quantized audio signal segment, for instance based on a selected quantized parameter.

The presented threshold based criterion can also be used in combination with various other types of criteria.

In one embodiment using such an additional criterion, it is further determined whether an error resulting with the non-predictive quantization of the audio signal segment is smaller than an error resulting with the predictive quantization of the audio signal segment. An audio signal segment quantized with the non-predictive quantization may then be provided in addition, in case the error resulting with the non-predictive quantization of the audio signal segment is smaller than the error resulting with the predictive quantization of the audio signal segment. As a result, an absolute minimization of an error is achieved for the remaining audio signal segments, even in the case of a transmission or storage free of errors.

In this embodiment, at least one of the errors resulting with the non-predictive quantization and with the predictive quantization could further be weighted before determining whether the error resulting with the non-predictive quantization of the audio signal segment is smaller than the error resulting with the predictive quantization of the audio signal segment. Such a weighting allows preferring the non-predictive quantization over the predictive quantization.

In another embodiment using such an additional criterion, it is further determined whether the latest provided quantized audio signal segment belongs to a sequence of audio signal segments quantized with the predictive quantization, in which the number of the segments exceeds a predetermined number. An audio signal segment quantized with the non-predictive quantization could then be provided in addition, in case it is determined that the number of audio signal segments quantized with the predictive quantization that has been provided in sequence exceeds the predetermined number.

It is to be understood that all presented exemplary embodiments may also be used in any suitable combination.

It is also to be understood that the described method, apparatus, device, system and program code can be employed with any kind of audio codec.

Any embodiment of the described invention can be employed for instance at the core layer of a variable bit rate—embedded variable rate speech codec (VBR-EV). Such a codec may be a wideband codec supporting a frequency range of 50-7000 Hz, with bit rates from 8 to 32 kbps. The codec core may work at 8 kbps, while additional layers with quite small granularity may increase the observed speech and audio quality. There might be for instance at least five bit rates of 8/12/16/24 and 32 kbps available from the same embedded bit stream.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and that they are merely intended to conceptually illustrate the structures and procedures described herein.

DETAILED DESCRIPTION OF THE INVENTION

Figure 1:
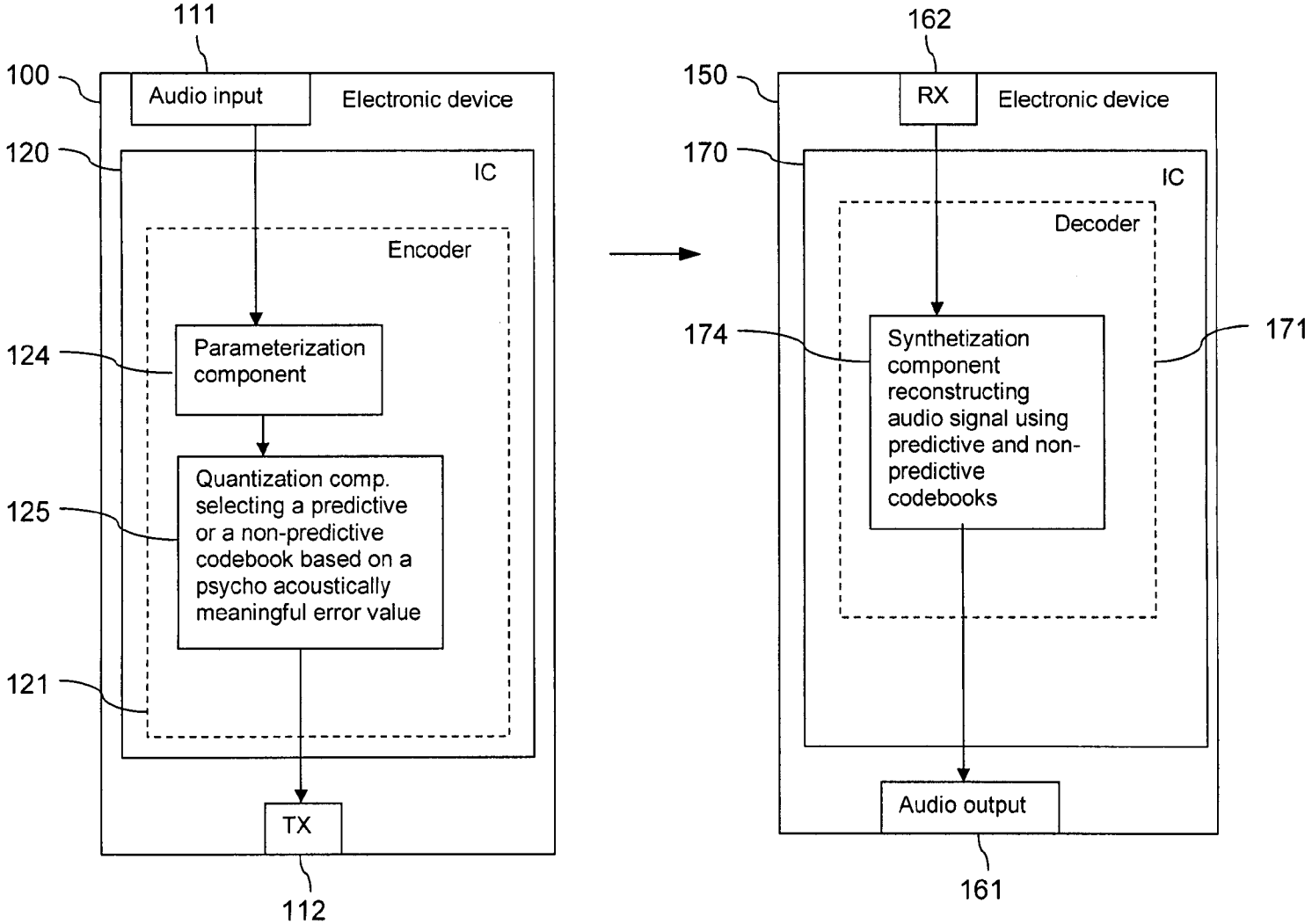
FIG. 1 is a schematic block diagram of a system according to an embodiment of the invention.

FIG. 1 is a schematic block diagram of an exemplary system, in which a selection of a predictive or non-predictive quantization in accordance with an embodiment of the invention can be implemented. The terms non-predictive quantization and safety-net quantization will be used synonymously.

The system comprises a first electronic device 100 and a second electronic device 150. The first electronic device 100 is configured to encode audio data for a wideband transmission and the second electronic device 150 is configured to decode encoded audio data.

Electronic device 100 comprises an audio input component 111, which is linked via a chip 120 to a transmitting component (TX) 112.

The audio input component 111 can be for instance a microphone or an interface to another device providing audio data.

The chip 120 can be for instance an integrated circuit (IC), which includes circuitry for an audio encoder 121, of which selected functional blocks are illustrated schematically. They include a parameterization component 124 and a quantization component 125.

The transmitting component 112 is configured to enable a transmission of data to another device, for example to electronic device 150, via a wired or a wireless link.

It is to be understood that the depicted connections can be realized via various components not shown.

The encoder 121 or the chip 120 could be seen as an exemplary apparatus according to the invention, and the quantization component as representing corresponding processing components.

Electronic device 150 comprises a receiving component 162, which is linked via a chip 170 to an audio output component 161.

The receiving component 162 is configured to enable a reception of data from another device, for example from electronic device 100, via a wired or a wireless link.

The chip 170 can be for instance an integrated circuit, which includes circuitry for an audio decoder 171, of which a synthesizing component 174 is illustrated.

The audio output component 161 can be for instance a loudspeaker or an interface to another device, to which decoded audio data is to be forwarded.

It is to be understood that the depicted connections can be realized via various components not shown.

An operation in the system of FIG. 1 will now be described in more detail with reference to FIG. 2.

Figure 2:
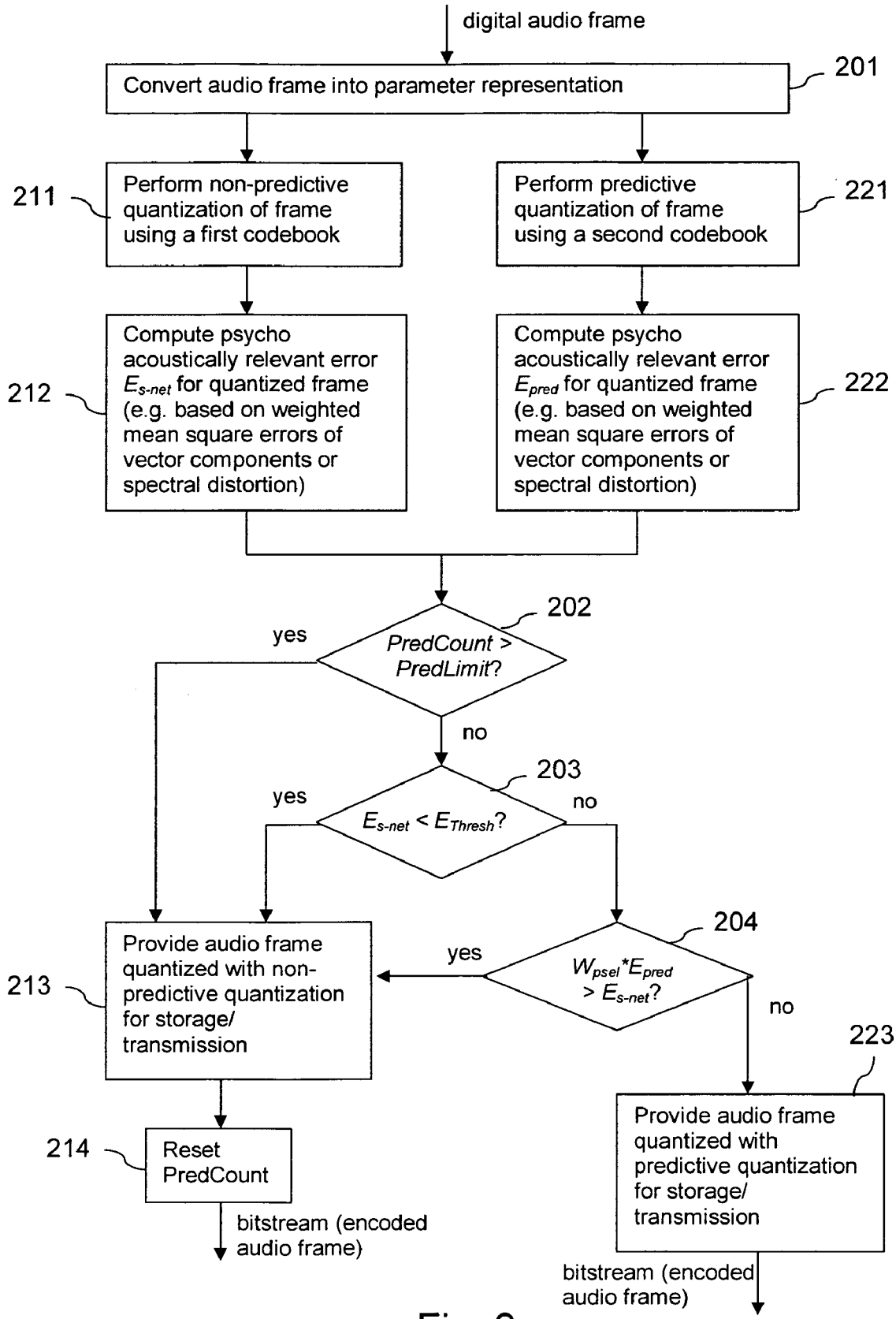
FIG. 2 is a diagram illustrating the selection of a predictive or non-predictive quantization in the system of FIG. 1.

FIG. 2 is a flow chart illustrating the operation in the audio encoder 121.

When an audio signal is input to electronic device 100, for example via the audio input component 111, it may be provided to the audio encoder 121 for encoding. Before the audio signal is provided to the audio encoder 121, it may be subjected to some pre-processing. In case an input audio signal is an analog audio signal, for instance, it may first be subjected to an analog-to-digital conversion, etc.

The audio encoder 121 processes the audio signal for instance in frames of 20 ms, using a lookahead of 10 ms. Each frame constitutes an audio signal segment.

The parameterization component 124 first converts the current audio frame into a parameter representation (step 201). In the present example, the parameters comprise values of an ISF vector and values of an LSF vector.

The quantization component 125 performs on the one hand a non-predictive quantization of parameters of the audio frame using a non-predictive codebook (step 211). The quantization component 125 could perform a quantization of selected parameters only at this stage. In the present example, the quantization component 125 applies a non-predictive quantization at least to values of an ISF vector in step 211.

In addition, the quantization component 125 determines a weighted error $E_{s\text{-}net}$ for current frame i (step 212):

$$E^i_{s-net} = \sum_{p=0}^{N-1} W^i_p (QIsfs^i_p - Isf^i_p)^2,$$

where N is the length of the quantized vector, where $QIsfs_p^i$ is a safety-net quantized optimal ISF vector value p for frame i, where $Isf_p^i$ is the original, unquantized ISF vector value p for frame i, and where $W_p^i$ is a psycho acoustically relevant weighting vector value p for frame i.

For the Global System for Mobile communications (GSM), it has been specified for example in another context that a weight $W_p$ for each vector value p can be determined based on LSF parameters for the current frame i using the following equation:

$$\begin{aligned} W_p &= 3.347 - \frac{1.547}{450} d_p && \text{for } d_p < 450\,\text{Hz} \\ &= 1.8 - \frac{0.8}{1050}(450 - d_p) && \text{otherwise,} \end{aligned}$$

where $d_p = LSF_{p+1} - LSF_{p-1}$ with $LSF_0 = 0$ Hz and $LSF_{11} = 4000$ Hz, LSF being the line spectral frequencies. The weights for the encoding for a wideband transmission as supported by the present embodiment can be determined for instance based on ISF parameters instead of LSF parameters, using equations that have been modified in a suitable manner. The weights $W_p$ can be summarized as a weighting vector W.

The quantization component 125 performs on the other hand a predictive quantization of parameters of the audio frame using a predictive codebook (step 221). The quantization component 125 could perform again a quantization of selected parameters only at this stage. In the present example, the quantization component 125 applies a predictive quantization at least to values of an ISF vector in step 221.

In addition, quantization component 125 determines a weighted error $E_{pred}$ for current frame i (step 222):

$$E_{pred}^{i} = \sum_{p=0}^{N-1} W_p^i (QIsfp_p^i - Isf_p^i)^2$$

where N is again the length of the quantized vector, where $QIsfp_p^i$ is a predictive quantized optimal ISF vector value p for frame i, where $Isf_p^i$ is again the original, unquantized ISF vector value p for frame i, and where $W_p^i$ is again a psycho acoustically relevant weighting vector value p for frame i.

Next, the quantization component 125 selects either a predictive quantization or a non-predictive quantization for the current frame based on the determined errors $E_{s\text{-}net}$ and $E_{pred}$.

To this end, the quantization component 125 determines at first, whether a count PredCount exceeds a predetermined limit PredLimit (step 202). The count PredCount indicates the number of frames that are based on a predictive quantization and that have been provided since the last selection of a non-predictive quantization. The limit PredLimit could be set for instance to three, but equally to any other desired value.

If the count PredCount exceeds the set limit PredLimit, the quantization component 125 provides the quantized audio frame that has been quantized in step 211 using the non-predictive quantization for transmission via transmitter 112 (step 213). In case only selected parameters had been quantized in step 211, the quantization component 125 now quantizes all parameters of the audio frame using the non-predictive quantization and provides them for transmission.

In addition, a counter counting the count PredCount is reset to zero (step 214).

If the count PredCount does not exceed the set limit, in contrast, the quantization component checks in addition, whether the determined error $E_{s\text{-}net}$ exceeds a predetermined threshold $E_{Thresh}$. The threshold $E_{Thresh}$ is set to a value below which the error $E_{s\text{-}net}$ is considered to be inaudible (step 203).

An appropriate threshold is different for different weighting functions and codec parameters, and it has to be calculated by trial-and-error off-line. But once a proper threshold has been found, the computational complexity increase at the encoder is minimal. In the present example, it could be close to 0.9 dB.

If it is determined that the error $E_{s\text{-}net}$ does not exceed the predetermined threshold $E_{Thresh}$, the quantization component 125 provides again a quantized audio frame that has been quantized using the non-predictive quantization for transmission via transmitter 112 (step 213). In addition, the counter counting the count PredCount is reset to zero (step 214).

If it is determined, in contrast, that the error $E_{s\text{-}net}$ exceeds the predetermined threshold $E_{Thresh}$, the quantization component 125 checks in addition, whether the error $E_{pred}$, determined in step 222 and weighted with a weighting factor $W_{psel}$, exceeds the error $E_{s\text{-}net}$, determined in step 212 (step 204). The weighting factor $W_{psel}$ is used in order to prefer safety-net codebook usage over predictive codebook usage.

If it is determined that the weighted error $E_{pred}$ exceeds the determined error $E_{s\text{-}net}$, the quantization component 125 provides again a quantized audio frame that has been quantized using the non-predictive quantization for transmission via transmitter 112 (step 213). In addition, the counter counting the count PredCount is reset to zero (step 214).

If it is determined, in contrast, that the weighted error $E_{pred}$ does not exceed the determined error $E_{s\text{-}net}$, the quantization component 125 finally provides the quantized audio frame, which has been quantized in step 221 using the predictive quantization, for transmission via transmitter 112 (step 223).

In case only selected parameters had been quantized in step 221, the quantization component 125 now quantizes all parameters of the audio frame using the predictive quantization and provides them for transmission.

The quantization selection can thus be summarized by the following pseudo-code:

```
If ((W_psel * E_pred^i > E_s-net^i) or (E_s-net^i < E_Thres)
                                or (PredCount>PredLimit))
    Use safety-net quantizer
    PredCount=0
Else
    Use predictive quantizer
    PredCount=PredCount+1
End
```

Thus, the non-predictive quantization is selected as often as possible without a significant degradation of audio quality, and in addition it is selected for interrupting long sequences of predictive quantization frames, as far as such sequences still occur.

In this code and the above described procedure, the weighting factor $W_{psel}$ could also be omitted. That is, it is not required that the non-predictive quantization is preferred over the predictive quantization. Further, the criteria (PredCount>PredLimit) is optional as well.

The provided quantized audio frames are transmitted by transmitter 112 as a part of encoded audio data in a bit stream together with further information, for instance together with an indication of the employed quantization and/or together with enhancement layer data etc.

At electronic device 150, the bit stream is received by the receiving component 162 and provided to the decoder 171. In the decoder 171, the synthesizing component 174 constructs a synthesized signal based on the quantized parameters in the received bit stream. The reconstructed audio signal may then be provided to the audio output component 161, possibly after some further processing, like a digital-to-analog conversion.

The blocks of FIG. 2 could also be understood as schematically represented, separate processing blocks of the quantization component 125.

Figure 3:
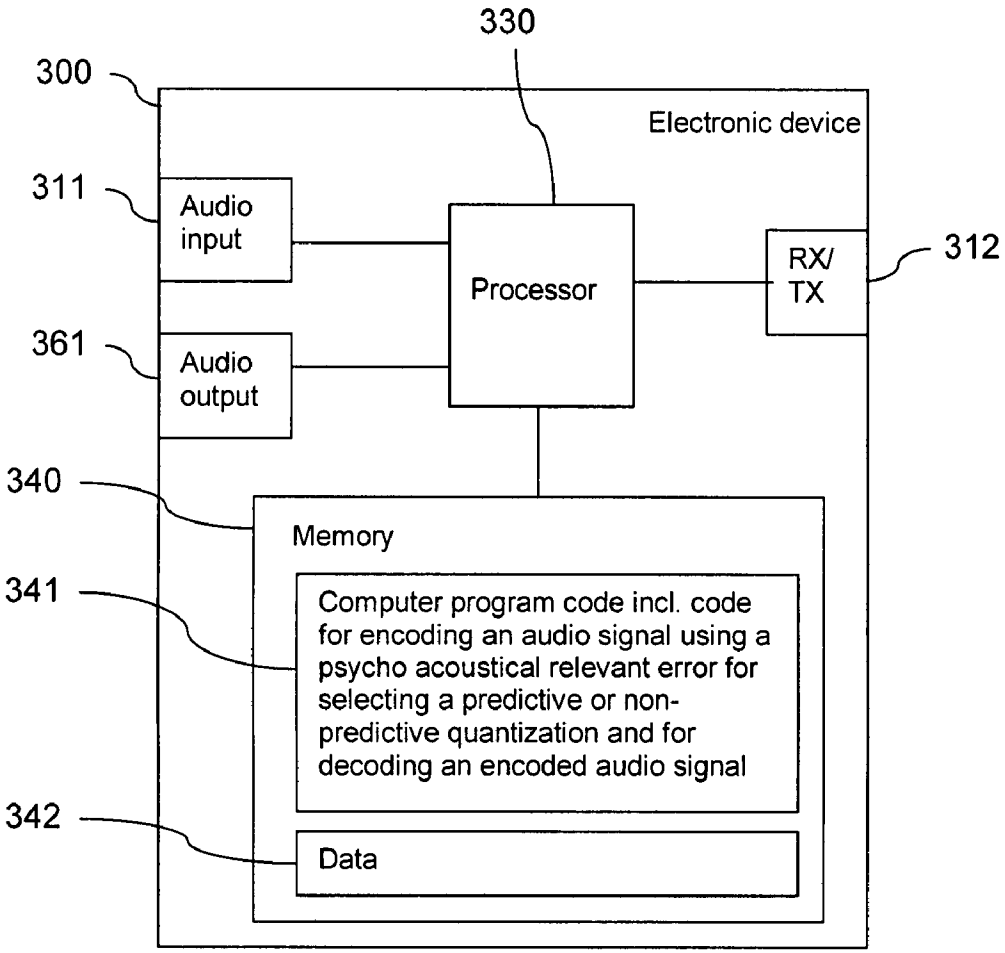
FIG. 3 is a schematic block diagram of a device according to an embodiment of the invention.

FIG. 3 is a schematic block diagram of an exemplary electronic device 300, in which a selection of a predictive or non-predictive quantization in accordance with an embodiment of the invention is implemented in software.

The electronic device 300 can be for example a mobile phone. It comprises a processor 330 and linked to this processor 330 an audio input component 311, an audio output component 361, a transceiver (RX/TX) 312 and a memory 340. It is to be understood that the indicated connections can be realized via various other elements not shown.

The audio input component 311 can be for instance a microphone or an interface to some audio source. The audio output component 361 can be for instance a loudspeaker. The memory 340 comprises a section 341 for storing computer program code and a section 342 for storing data. The stored computer program code comprises code for encoding audio signals using a selectable quantization and code for decoding audio signals. The processor 330 is configured to execute available computer program code. As far as the available code is stored in the memory 340, the processor 330 may retrieve the code to this end from section 341 of the memory 340 whenever required. It is to be understood that various other computer program code is available for execution as well, like an operating program code and program code for various applications.

The stored encoding code or the processor 330 in combination with the memory 340 could also be seen as an exemplary apparatus according to the invention. The memory 340 could be seen as an exemplary computer program product according to the invention.

When a user selects a function of the electronic device 300, which requires an encoding of an input audio signal, an application providing this function causes the processor 330 to retrieve the encoding code from the memory 340.

Audio signals received via the audio input component 311 are then provided to the processor 330—in the case of received analog audio signals after a conversion to digital audio signals, etc.

The processor 330 executes the retrieved encoding code to encode the digital audio signal. The encoding may correspond to the encoding described above for FIG. 1 with reference to FIG. 2.

The encoded audio signal is either stored in the data storage portion 342 of the memory 340 for later use or transmitted by the transceiver 312 to another electronic device.

The processor 330 may further retrieve the decoding code from the memory 340 and execute it to decode an encoded audio signal that is either received via the transceiver 312 or retrieved from the data storage portion 342 of the memory 340. The decoding may correspond to the decoding described above for FIG. 1.

The decoded digital audio signal may then be provided to the audio output component 361. In case the audio output component 361 comprises a loudspeaker, the decoded audio signal may for instance be presented to a user via the loudspeaker after a conversion into an analog audio signal. Alternatively, the decoded digital audio signal could be stored in the data storage portion 342 of the memory 340.

The functions illustrated by the quantization component 125 of FIG. 1 or the functions illustrated by the processor 330 executing program code 341 of FIG. 3 can also be viewed as means for determining whether an error resulting with a non-predictive quantization of an audio signal segment lies below a predetermined threshold value; as means for providing an audio signal segment quantized with the non-predictive quantization as a part of an encoded audio signal at least in case it is determined that the error resulting with the non-predictive quantization of the audio signal segment lies below a predetermined threshold value; and as means for providing otherwise an audio signal segment quantized with predictive quantization as a part of an encoded audio signal.

The program codes 341 can also be viewed as comprising such means in the form of functional modules or code components.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures.

What is claimed is:

1. A method comprising:

a processor of an electronic device:

determining whether an error resulting with a non-predictive quantization of parameters representing an audio signal segment lies below a predetermined threshold value;

providing parameters representing an audio signal segment quantized with said non-predictive quantization as a part of an encoded audio signal at least in case it is determined that said error resulting with said non-predictive quantization of said parameters representing an audio signal segment lies below a predetermined threshold value; and providing otherwise parameters representing an audio signal segment quantized with predictive quantization as a part of an encoded audio signal.

2. The method according to claim 1, wherein said predetermined threshold is a threshold below which said error is considered to be inaudible.

3. The method according to claim 1, wherein said error is a spectral distortion over a frequency range between said original parameters representing an audio signal segment and parameters representing an audio signal segment resulting with said non-predictive quantization.

4. The method according to claim 1, wherein said error is obtained by combining weighted errors between a respective component of said parameters representing an audio signal segment and a corresponding component of said parameters representing an audio signal segment resulting with said non-predictive quantization.

5. The method according to claim 4, wherein said error is obtained by combining weighted mean square errors.

6. The method according to claim 4, wherein said weighting of errors is a psycho acoustically meaningful weighting.

7. The method according to claim 1, further comprising determining whether an error resulting with said non-predictive quantization of said parameters representing an audio signal segment is smaller than an error resulting with said predictive quantization of said parameters representing an audio signal segment, wherein parameters representing an audio signal segment quantized with said non-predictive quantization is provided in addition in case said error resulting with said non-predictive quantization of said parameters representing an audio signal segment is smaller than said error resulting with said predictive quantization of said parameters representing an audio signal segment.

8. The method according to claim 7, wherein at least one of said errors resulting with said non-predictive quantization and with said predictive quantization is weighted before determining whether said error resulting with said non-predictive quantization of said parameters representing an audio signal segment is smaller than said error resulting with said predictive quantization of said parameters representing an audio signal segment.

9. The method according to claim 1, further comprising determining whether a latest audio signal segment for which quantized parameters have been provided belongs to a sequence of audio signal segments for which parameters have been quantized with said predictive quantization, a number of said segments exceeding a predetermined number, wherein parameters representing an audio signal segment quantized with said non-predictive quantization is provided in addition in case it is determined that said number of segments for which parameters quantized with said predictive quantization have been provided in sequence exceeds said predetermined number.

10. An apparatus comprising:

at least one processing component; and at least one memory including computer program code;

to the at least one memory and the computer program code configured to, with the at least one processing component, cause the apparatus at least to:

determine whether an error resulting with a non-predictive quantization of parameters representing an audio signal segment lies below a predetermined threshold value;

provide an audio signal segment quantized with said non-predictive quantization as a part of parameters representing an encoded audio signal at least in case it is determined that said error resulting with said non-predictive quantization of said parameters lies below a predetermined threshold value; and provide otherwise parameters representing an audio signal segment quantized with predictive quantization as a part of an encoded audio signal.

11. The apparatus according to claim 10, wherein said predetermined threshold is a threshold below which said error is considered to be inaudible.

12. The apparatus according to claim 10, further comprising a processing component configured to compute said error as a spectral distortion over a frequency range between said original parameters representing an audio signal segment and parameters representing an audio signal segment resulting with said non-predictive quantization.

13. The apparatus according to claim 10, further comprising a processing component configured to compute said error by combining weighted errors between a respective component of said parameters representing an audio signal segment and a corresponding component of said parameters representing an audio signal segment resulting with said non-predictive quantization.

14. The apparatus according to claim 13, wherein said error is obtained by combining weighted mean square errors.

15. The apparatus according to claim 13, wherein said weighting of errors is a psycho acoustically meaningful weighting.

16. The apparatus according to claim 10, further comprising a processing component configured to determine whether an error resulting with said non-predictive quantization of said parameters representing an audio signal segment is smaller than an error resulting with said predictive quantization of said parameters representing an audio signal segment, wherein parameters representing an audio signal segment quantized with said non-predictive quantization is provided in addition in case said error resulting with said non-predictive quantization of said parameters representing an audio signal segment is smaller than said error resulting with said predictive quantization of said parameters representing an audio signal segment.

17. The apparatus according to claim 16, wherein at least one of said errors resulting with said non-predictive quantization and with said predictive quantization is weighted before determining whether said error resulting with said non-predictive quantization of said parameters representing an audio signal segment is smaller than said error resulting with said predictive quantization of said parameters representing an audio signal segment.

18. The apparatus according to claim 10, further comprising a processing component configured to determine whether a latest audio signal segment for which quantized parameters have been provided belongs to a sequence of audio signal segments for which parameters have been quantized with said predictive quantization, a number of said segments exceeding a predetermined number, wherein parameters representing an audio signal segment quantized with said non-predictive quantization are provided in addition in case it is determined that said number of segments for which parameters quantized with said predictive quantization have been provided in sequence exceeds said predetermined number.

19. An apparatus comprising:

means for determining whether an error resulting with a non-predictive quantization of parameters representing an audio signal segment lies below a predetermined threshold value;

means for providing parameters representing an audio signal segment quantized with said non-predictive quantization as a part of an encoded audio signal at least in case it is determined that said error resulting with said non-predictive quantization of said parameters representing audio signal segment lies below a predetermined threshold value; and means for providing otherwise parameters representing an audio signal segment quantized with predictive quantization as a part of an encoded audio signal.

20. A non-transitory computer readable medium in which program code is stored, said program code realizing the following when executed by a processor:

determining whether an error resulting with a non-predictive quantization of parameters representing an audio signal segment lies below a predetermined threshold value;

providing parameters representing an audio signal segment quantized with said non-predictive quantization as a part of an encoded audio signal at least in case it is determined that said error resulting with said non-predictive quantization of said parameters representing an audio signal segment lies below a predetermined threshold value; and providing otherwise parameters representing an audio signal segment quantized with predictive quantization as a part of an encoded audio signal.

21. The non-transitory computer readable medium according to claim 20, said program code further realizing:

determining whether a latest audio signal segment for which quantized parameters have been provided belongs to a sequence of audio signal segments for which parameters have been quantized with said predictive quantization, a number of said segments exceeding a predetermined number, wherein parameters representing an audio signal segment quantized with said non-predictive quantization is provided in addition in case it is determined that said number of audio signal segments for which parameters quantized with said predictive quantization have been provided in sequence exceeds said predetermined number.

22. The non-transitory computer readable medium according to claim 20, wherein said predetermined threshold is a threshold below which said error is considered to be inaudible.

23. The non-transitory computer readable medium according to claim 20, wherein said error is a spectral distortion over a frequency range between said original parameters representing an audio signal segment and parameters representing an audio signal segment resulting with said non-predictive quantization.

24. The non-transitory computer readable medium according to claim 20, wherein said error is obtained by combining weighted errors between a respective component of said original parameters representing an audio signal segment and a corresponding component of said parameters representing an audio signal segment resulting with said non-predictive quantization.

25. The non-transitory computer readable medium according to claim 24, wherein said error is obtained by combining weighted mean square errors.

26. The non-transitory computer readable medium according to claim 24, wherein said weighting of errors is a psycho acoustically meaningful weighting.

27. The non-transitory computer readable medium according to claim 20, said program code further realizing:

determining whether an error resulting with said non-predictive quantization of said parameters representing an audio signal segment is smaller than an error resulting with said predictive quantization of said parameters representing an audio signal segment, wherein parameters representing an audio signal segment quantized with said non-predictive quantization is provided in addition in case said error resulting with said non-predictive quantization of said parameters representing an audio signal segment is smaller than said error resulting with said predictive quantization of said parameters representing an audio signal segment.

28. The non-transitory computer readable medium according to claim 27, wherein at least one of said errors resulting with said non-predictive quantization and with said predictive quantization is weighted before determining whether said error resulting with said non-predictive quantization of said parameters representing an audio signal segment is smaller than said error resulting with said predictive quantization of said a parameters representing an audio signal segment.

* * * * *

UNITED STATES PATENT AND TRADEMARK OFFICE

CERTIFICATE OF CORRECTION

PATENT NO. : 7,813,922 B2
APPLICATION NO. : 11/700732
DATED : October 12, 2010
INVENTOR(S) : Anssi Ramo et al.

It is certified that error appears in the above-identified patent and that said Letters Patent is hereby corrected as shown below:

In column 11, line 7, which is claim 10, line 4 “to” should be --at--.

Signed and Sealed this
Twelfth Day of April, 2011

David J. Kappos

David J. Kappos
*Director of the United States Patent and Trademark Office*